US008021640B2

(12) United States Patent
Kim et al.

(10) Patent No.: US 8,021,640 B2
(45) Date of Patent: Sep. 20, 2011

(54) MANUFACTURING CARBON NANOTUBE PAPER

(75) Inventors: Yong Hyup Kim, Seoul (KR); Eui Yun Jang, Seoul (KR)

(73) Assignee: SNU R&DB Foundation, Seoul (KR)

( * ) Notice: Subject to any disclaimer, the term of this patent is extended or adjusted under 35 U.S.C. 154(b) by 5 days.

(21) Appl. No.: 12/198,815

(22) Filed: Aug. 26, 2008

(65) Prior Publication Data

US 2010/0055023 A1 Mar. 4, 2010

(51) Int. Cl.
*D01F 9/12* (2006.01)

(52) U.S. Cl. ..... 423/447.1; 977/845; 977/742

(58) Field of Classification Search ..... 423/447.1; 977/845, 742
See application file for complete search history.

(56) References Cited

U.S. PATENT DOCUMENTS

| | | | | |
|---|---|---|---|---|
| 4,841,786 | A | 6/1989 | Schulz | |
| 5,763,879 | A | 6/1998 | Zimmer et al. | |
| 5,948,360 | A | 9/1999 | Rao et al. | |
| 6,781,166 | B2 | 8/2004 | Lieber et al. | |
| 6,905,667 | B1 * | 6/2005 | Chen et al. | 423/447.1 |
| 7,147,894 | B2 | 12/2006 | Zhou et al. | |
| 7,164,209 | B1 | 1/2007 | Duan et al. | |
| 7,385,295 | B2 | 6/2008 | Son et al. | |
| 2002/0014667 | A1 | 2/2002 | Shin et al. | |
| 2002/0069505 | A1 * | 6/2002 | Nakayama et al. | 29/464 |
| 2002/0127162 | A1 * | 9/2002 | Smalley et al. | 422/198 |
| 2004/0265550 | A1 | 12/2004 | Glatkowski et al. | |
| 2006/0060825 | A1 | 3/2006 | Glatkowski | |
| 2006/0099135 | A1 | 5/2006 | Yodh et al. | |
| 2006/0274048 | A1 | 12/2006 | Spath et al. | |
| 2007/0007142 | A1 | 1/2007 | Zhou et al. | |
| 2007/0014148 | A1 | 1/2007 | Zhou et al. | |
| 2007/0020458 | A1 | 1/2007 | Su et al. | |
| 2007/0045119 | A1 | 3/2007 | Sandhu | |
| 2007/0248528 | A1 | 10/2007 | Kim | |
| 2008/0044651 | A1 | 2/2008 | Douglas | |
| 2008/0044775 | A1 | 2/2008 | Hong et al. | |
| 2008/0048996 | A1 | 2/2008 | Hu et al. | |
| 2008/0290020 | A1 | 11/2008 | Marand et al. | |
| 2009/0059535 | A1 | 3/2009 | Kim et al. | |

FOREIGN PATENT DOCUMENTS

| | | |
|---|---|---|
| DE | 69728410 T2 | 12/1998 |
| KR | 1020070112733 | 11/2007 |

OTHER PUBLICATIONS

Hulman et al. , The dielectrophoretic attachent of nanotube fibres on tungsten needles, Mar. 6, 2007, Nanotechnology, 18, 1-5.*

Kang et al. ,Sandwich-type laminated nanocomposites developed by selective dip-coating of carbon nanotubes, Advanced Materials, 2007, 119, 427-432.*

Liu et al. , Controlled deposition of individual single-walled carbon nanotubes on chemically functonalize templates, Chemical Physicas Letters, Apr. 2, 1999, 303, 125-129.*

(Continued)

*Primary Examiner* — Jerry A Lorengo
*Assistant Examiner* — Pritesh Darji
(74) *Attorney, Agent, or Firm* — Knobbe, Martens, Olson & Bear, LLP

(57) ABSTRACT

Techniques and apparatuses for making carbon nanotube (CNT) papers are provided. In one embodiment, a method for making a CNT paper may include disposing a structure having an edge portion including a relatively sharp edge into a CNT colloidal solution and withdrawing the structure from the CNT colloidal solution.

17 Claims, 6 Drawing Sheets

OTHER PUBLICATIONS

Liu et al., "Controlled Growth of Super-Aligned Carbon Nanotube Arrays for Spinning Continuous Unidirectional Sheets with Tunable Physical Properties", NANO Letters, vol. 8, No. 2, pp. 700-705 (2008).
Ma et al., "Directly Synthesized Strong, Highly Conducting, Transparent Single-Walled Carbon Nanotube Films," NANO Letters, vol. 7, No. 8, pp. 2307-2311 (2007).
Goldstein et al., "Zero TCR Foil Resistor Ten Fold Improvement in Temperature Coefficient", Electronic Components and Tech. Conf., IEEE, 2001.
Im, et al., "Directed-assembly of Single-walled Carbon Nanotubes Using Self-assembled Monolayer Patterns Comprising Conjugated Molecular Wires," *Nanotechnology*, (2006) vol. 17: pp. 3569-3573.
International Search Report dated Mar. 5, 2009 for corresponding PCT Application No. PCT/KR2008/007144 filed Dec. 3, 2008.
Jiang et al., "Spinning continuous carbon nanotube yarns", Nature, vol. 419, 801 (2002).
Kaempgen et al., "Transparent carbon nanotube coatings," Applied Surface Science 252; pp. 425-429 (2005).
Ko et al., "Electrospinning of Continuous Carbon Nanotube-Filled Nanofiber Yarns", Adv. Mater., 15, No. 14, pp. 1161-1165 (2003).
Kumar et al., "Search for a novel zero thermal expansion material: dilatometry of the Agl-Cul system", J. Mater Sci. 41, pp. 3861-3865 (2006).
Kwon et al., "Thermal Contraction of Carbon Fullerenes and Nanotubes", Phy. Rev. Lett., vol. 92, No. 1, pp. 015901-015904 (2004).
Kwon, "Computational Modeling and Applications of Carbon Nanotube Devices", NSI Workshop Series-IV, Jul. 11, 2007.
Lee et al., "Linker-free directed assembly of high-performance integrated devices based on nanotubes and nanowires", Nature Nanotechnology, vol. 1, pp. 66-71, Oct. 2006.
Lewenstein, et al., "High-yield Selective Placement of Carbon Nanotubes on Pre-patterned Electrodes," *NanoLetters*, (2002) vol. 2, Issue (5): pp. 443-446.
Li et al., "Direct Spinning of carbon Nanotube Fibers from Chemical Vapor Deposition Synthesis", Science, vol. 304, 276-278 (2004).
Liu et al., "Controlled Growth of Super-Aligned Carbon Nanotube Arrays for Spinning Continuous Unidirectional Sheets with Tunable Physical Properties", Nano Letters, vol. 8, No. 2, pp. 700-705 (2008).
Nakagawa, et al., "Controlled Deposition of Silicon Nanowires on Chemically Patterned Substrate by Capillary Force Using a Blade-coating Method," *J. Phys. Chem.*, (2008) vol. 112: pp. 5390-6.
Rao et al., "Large-scale assembly of carbon nanotubes", Nature, vol. 425, pp. 36-37, Sep. 4, 2003.
Wang et al., "Controlling the shape, orientation, and linkage of carbon nanotube features with nano affinity templates", PNAS, vol. 103, No. 7, pp. 2026-2031 (2006).
Zhang et al., "Multifunctional Carbon Nanotube Yarns by Downsizing an Ancient Technology", Science, vol. 306, 1358-1361 (2004).
Office Action dated Sep. 18, 2009 from U.S. Appl. No. 12/195,347, filed Aug. 20, 2008.
Office Action dated Jan. 28, 2010 from U.S. Appl. No. 12/195,347, filed Aug. 20, 2008.
Office Action dated Jun. 30, 2009 from U.S. Appl. No. 12/192,024, filed Aug. 14, 2008.
Office Action dated Oct. 19, 2009 from U.S. Appl. No. 12/192,024, filed Aug. 14, 2008.
Office Action dated May 7, 2010 from U.S. Appl. No. 12/192,024, filed Aug. 14, 2008.
Office Action dated Jul. 20, 2009 from U.S. Appl. No. 12/198,835, filed Aug. 26, 2008.
Office Action dated Feb. 2, 2010 from U.S. Appl. No. 12/198,835, filed Aug. 26, 2008.
Office Action dated Jun. 18, 2010 from U.S. Appl. No. 12/198,835, filed Aug. 26, 2008.
Annamalai, et al., Electrophoretic drawing of continuous fibers of single-walled carbon nanotubes, *J. Appl. Phys.*, 98 114307-1 through 114307-6 (2005).
Brioude, et al., "Synthesis of sheathed carbon nanotube tips by the sol-gel technique," Applied Surface Science, 221, 2004, pp. 4-9.
Dong, et al., "Synthesis, assembly and device of 1-dimentional nanostructures," *Chinese Science Bulletin*, 47(14), 2002, pp. 1149-1157.
International Written Opinion dated Mar. 5, 2009 for corresponding PCT Application No. PCT/KR2008/007144 filed Dec. 3, 2008.
Kornev, et al., "Ribbon-to-Fiber Transformation in the Process of Spinning of Carbon-Nanotube Dispersion," *Physical Review Letters*, 97, 188303-1 through 188303-4, 2006.
Poulin, et al., "Films and fibers of oriented single wall nanotubes," *Carbon*, 40 (2002) pp. 1741-1749.
Tang, et al., "Assembly of 1D Nanostructures into Sub-micrometer Diameter Fibrils with Controlled and Variable Length by Dielectrophoresis," *Adv. Mater.*, 15, No. 16, pp. 1352-1355, 2003.
Office Action dated Aug. 24, 2010 from U.S. Appl. No. 12/192,024, filed Aug. 14, 2008.
Office Action dated Jan. 6, 2011 from U.S. Appl. No. 12/192,024, filed Aug. 14, 2008.
Office Action dated Mar. 3, 2011 from U.S. Appl. No. 12/192,024, filed Aug. 14, 2008.
Office Action dated Nov. 15, 2010 from U.S. Appl. No. 12/195,347, filed Aug. 20, 2008.
Office Action dated Oct. 4, 2010 from U.S. Appl. No. 12/198,835, filed Aug. 26, 2008.

* cited by examiner

MANUFACTURING CARBON NANOTUBE PAPER

TECHNICAL FIELD

The present disclosure relates generally to carbon nanotubes (CNTs) and, more particularly, to making carbon nanotube (CNT) paper.

BACKGROUND

Recently, CNTs have attracted attention in many research areas due to their mechanical, thermal, and electrical properties. In order to transfer the properties of the CNTs to meso- or macro-scale structures, efforts have been made toward the development of new structures containing CNTs.

DETAILED DESCRIPTION

Figure 1:
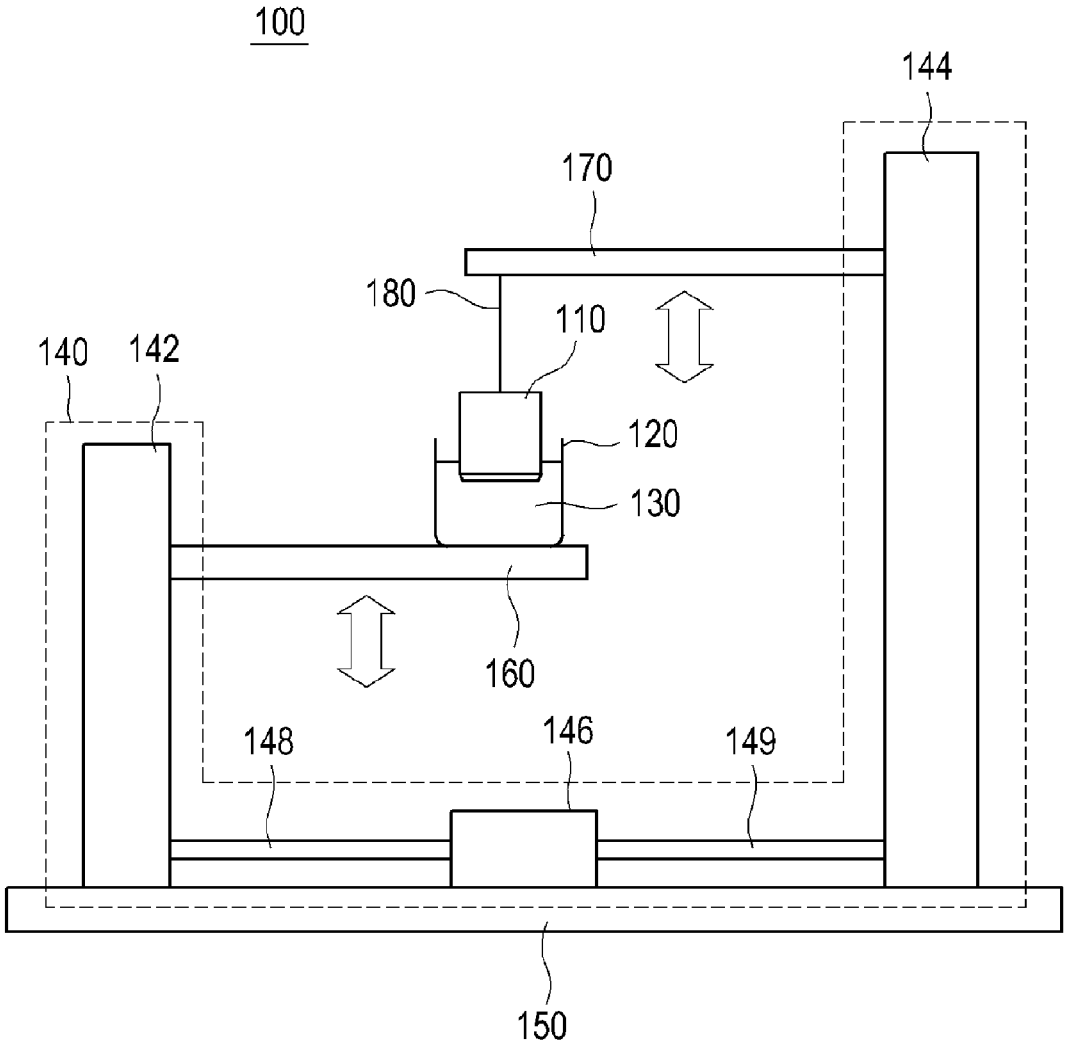
FIG. 1 is a schematic diagram of an illustrative embodiment of an apparatus for making CNT paper.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the components of the present disclosure, as generally described herein, and illustrated in the Figures, can be arranged, substituted, combined, and designed in a wide variety of different configurations, all of which are explicitly contemplated and made part of this disclosure.

CNTs may be assembled to form CNT papers, sheets, wraps, or films having a two-dimensional structure and improved mechanical, electrical, and chemical characteristics. CNT papers may be used in various applications, such as armors, sensors, diodes, polarized light sources, etc.

FIG. 1 is a schematic diagram of an illustrative embodiment of an apparatus 100 for making a CNT paper. As depicted, the apparatus 100 may include a structure 110, a container 120 that may be configured to contain a CNT colloidal solution 130, and a manipulator 140 that may be configured to dip the structure 110 in and out of the CNT colloidal solution 130. The manipulator 140 may be mounted on a base 150 and may include a left guider 142 and a right guider 144, which may be mounted on the base 150. The manipulator 140 may also include a motor unit 146. The motor unit 146 may be coupled with the left guider 142 and the right guider 144 via a first shaft 148 and a second shaft 149, respectively. The left guider 142 and the right guider 144 may include gears (not shown) that may convert the rotational movements of the first shaft 148 and second shaft 149, respectively, to vertical translational movements. In some embodiments, the manipulator 140 may be configured to include only one of the first and second shafts 148, 149.

A supporting member 160 may be configured to be movably associated with the left guider 142 so that it moves upward or downward along the left guider 142 by operation of the motor unit 146 (via the first shaft 148), as illustrated in FIG. 1. The container 120 configured to contain the CNT colloidal solution 130 may be placed on the supporting member 160, and the upward and downward movements of the supporting member 160 may cause the container 120 to move toward or away from the structure 110. The gears of the left guider 142 may be configured to move the supporting member 160 upward and downward via a belt-driven mechanism, for example.

A hanger 170 may be mounted to the right guider 144 and may be associated with the structure 110 via a holder 180. The structure 110 may be associated with the holder 180 in a detachable manner. The hanger 170 may be configured to be movably associated with the right guider 144, so that it may move upward or downward along the right guider 144 by operation of the motor unit 146 (via the second shaft 149), as illustrated in FIG. 1. The upward or downward movements of the hanger 170 may cause the structure 110 to move toward the container 120 for immersion of the structure 110 in the CNT colloidal solution 130 or move away from the container 120 for withdrawal of the structure 110 from the CNT colloidal solution 130. The supporting member 160 and the hanger 170 may be raised and lowered, respectively, at the same time or separately, by operation of the motor unit 146, so that the structure 110 may be immersed in the CNT colloidal solution 130. In some embodiments, the supporting member 160 associated with the left guider 142 may remain fixed, while the hanger 170 associated with the right guider 144 may be movable. In other embodiments, the hanger 170 associated with the right guider 144 may remain fixed, while the supporting member 160 associated with the left guider 142 may be movable.

The motor unit 146 may be automatically controlled by a computer or a processor with a processor-readable or computer-readable medium having instructions and programs stored thereon for controlling the operations of the manipulator 140, such as, for example, the disposing and withdrawal of the structure 110 into and from the CNT colloidal solution 130, respectively. The motor unit 146 may be configured to control either the supporting member 160 or the hanger 170, or both.

Figure 2:
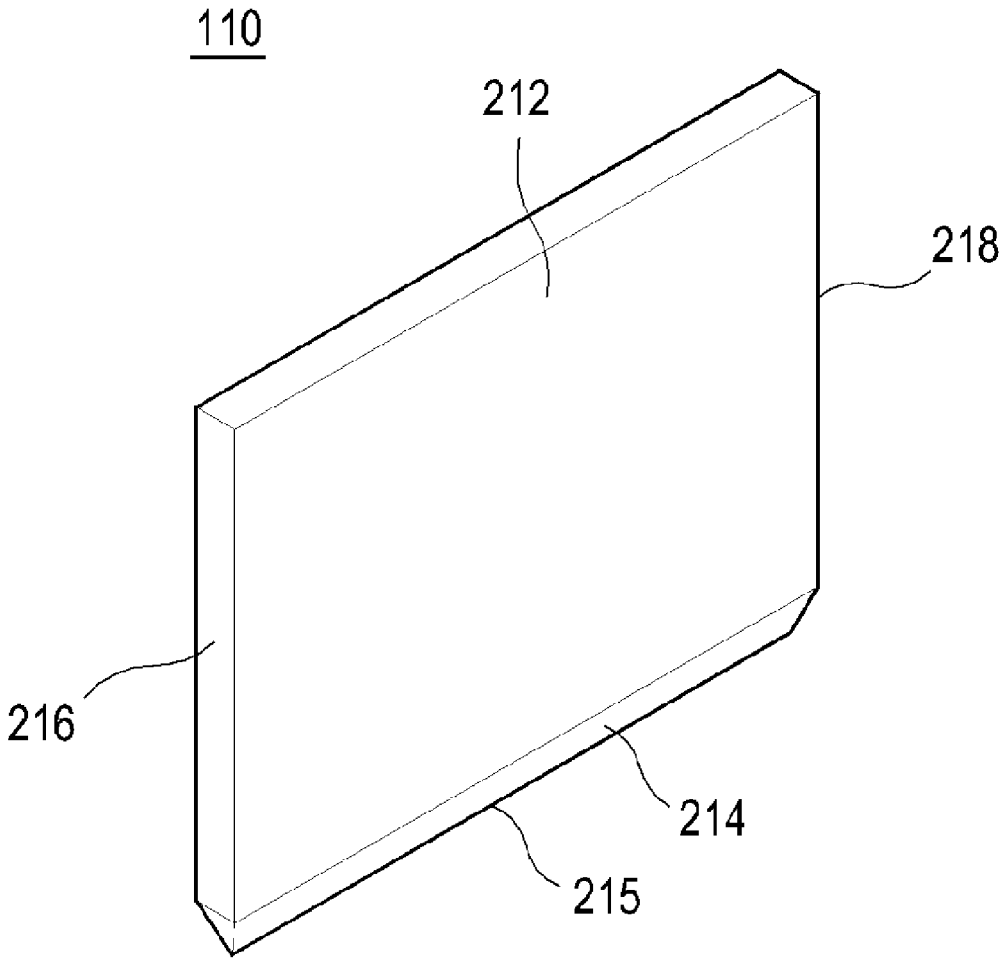
FIG. 2 shows an illustrative embodiment of a structure having an edge portion including a relatively sharp edge.

FIG. 2 shows an illustrative embodiment of the structure 110. As depicted, the structure 110 may have a body portion 212, and an edge portion 214, which may include a relatively sharp edge 215, and two opposing side edges 216, 218. For instance, the structure 110 may resemble a commercially available razor, for example, Dorco ST300 produced and made available by Dorco Korea Co., Ltd. (Seoul, Korea), having a relatively sharp horizontal edge portion. It will be appreciated in light of the present disclosure that the illustrative embodiment depicted in FIG. 2 is only being disclosed for illustrative purposes and is not meant to be limiting in any way. For example, the edge portion 214 may have various other shapes, such as but not limited to, curvy shape, sawtooth shape, etc., as long as it has the relatively sharp edge 215 at the bottom. The relatively sharp edge 215 of the edge portion 214 may be relatively sharp enough such that CNTs in the CNT colloidal solution 130 may adhere to the relatively sharp edge 215 to form a CNT paper when the structure 110 may be withdrawn from the CNT colloidal solution 130. The relatively sharp edge 215 of the edge portion 214 of the structure 110 may have a thickness ranging from about 0.5 nm to about 300 μm. In some embodiments, the thickness may range from about 1 nm to about 300 μm, from about 10 nm to about 300 μm, from about 100 nm to about 300 μm, from about 1 μm to about 300 μm, from about 10 μm to about 300 μm, from about 100 μm to about 300 μm, from about 0.5 nm to about 100 μm, from about 0.5 nm to about 10 μm, from about 0.5 nm to about 1 μm, from about 0.5 nm to about 100 nm, from about 0.5 nm to about 10 nm, from about 0.5 nm to about 1 nm, from about 1 nm to about 10 nm, from about 10 nm to about 100 nm, from about 100 nm to about 1 μm, from about 1 μm to about 10 μm, or from about 10 μm to about 100 μm. In some other embodiments, the thickness may be about 0.5 nm, about 1 nm, about 10 nm, about 100 nm, about 1 μm, about 10 μm, about 100 μm, or about 300 μm. The body portion 212 of the structure 110 is not limited to a thin plate shape as illustrated in FIG. 2, but may have, for example, a triangular or trapezoidal plate shape, a lump-like shape, or any other shape such that the body portion 212 may be associated with the edge portion 214 comprising the relatively sharp edge 215. The dimensions of the structure 110 may vary depending on the design requirements for the CNT paper.

In one embodiment, the edge portion 214 may include a hydrophilic surface property. Most metals, such as, for example, tungsten, may exhibit hydrophilic surface properties and may have good wettability with CNT colloidal solutions. The edge portion 214 may be formed by etching a metal plate by an anodic oxidation process based on an electrochemical etching method. In addition to metal, various other materials may be included in the edge portion 214. For example, the edge portion 214 may include a non-hydrophilic material and a coating that may be hydrophilic. In one embodiment, the edge portion 214 may have a coating of self-assembled monolayers (for example, 16-mercaptohexadecanoic acid or aminoethanethiol).

Figure 3:
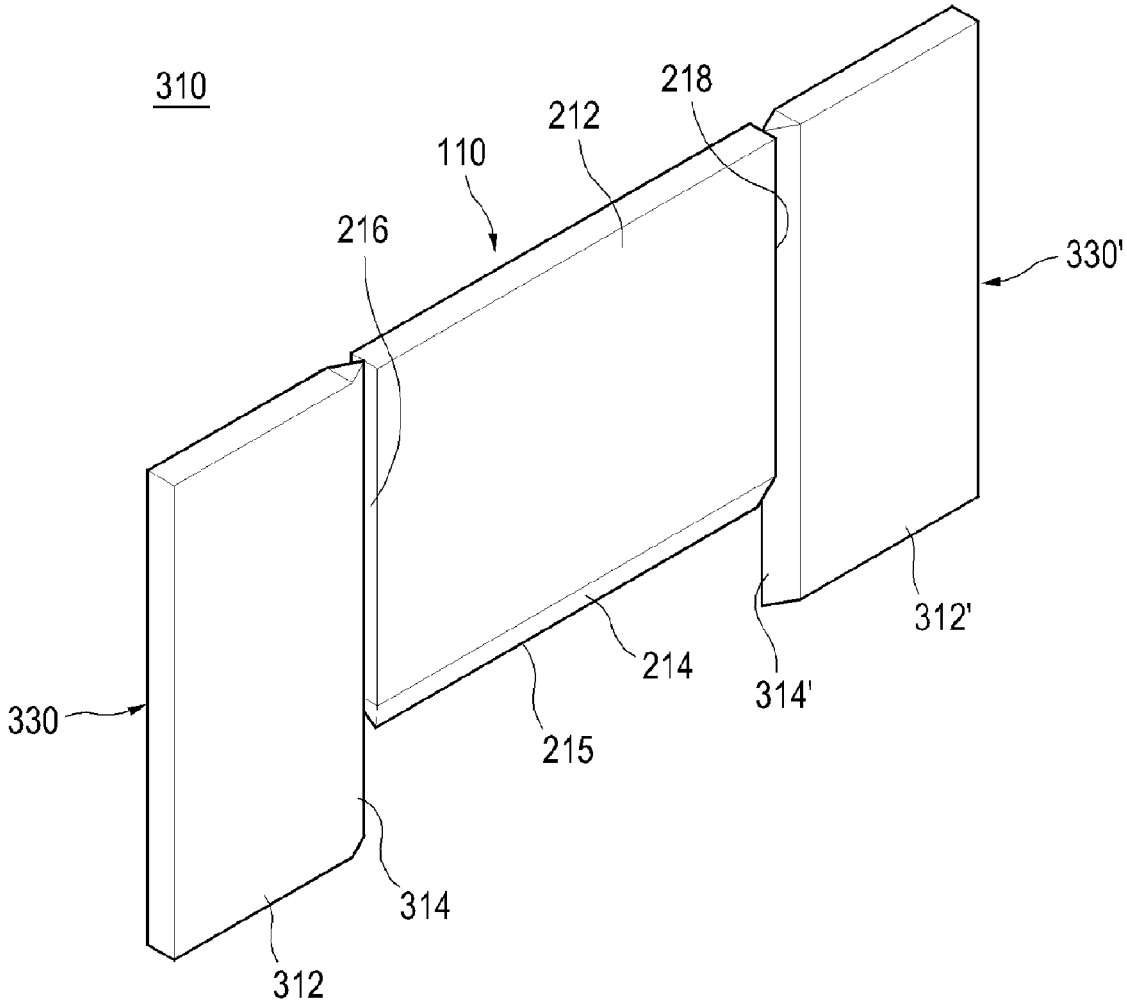
FIG. 3 shows an illustrative embodiment of a structure having an edge portion including a relatively sharp edge and extensions.

FIG. 3 shows an illustrative embodiment of a structure 310 including a set of extensions 330, 330'. As depicted, the extensions 330, 330' may be attached to opposing side edges 216, 218 of the structure 110 shown in FIG. 2, such that at least a portion of the extensions 330, 330' may extend lower than the edge portion 214 of the structure 110. Extensions 330, 330' may include body portions, 312, 312' and edge portions 314, 314', which may have relatively sharp edges. The extensions 330, 330' may resemble a commercially available razor, such as, for example, Dorco ST300. In other embodiments, the extensions 330, 330' may not include separate edge portions 314, 314'. As an example, the extensions 330, 330' may be thin plates with no separate edge portions. The extensions 330, 330' may be attached to the structure 110 such that the edge portions 314, 314' of the extensions 330, 330', respectively, face each other, as illustrated in FIG. 3. In one embodiment, the structure 310 including the extensions 330, 330' may be constructed by making the extensions 330, 330' and the structure 110 separately and subsequently attaching them to each other. In another embodiment, the structure 310 including the extensions 330, 330' may be formed as a single piece in a single step, such as, for example, by molding.

Referring again to FIG. 1, the container 120 may be a reservoir, which may have a generally rectangular box shape including a horizontal cross section of a generally rectangular shape, and an open top portion. However, the container 120 may have a variety of shapes and sizes that may hold the CNT colloidal solution 130 and may be large enough and shaped such that the structure 110 may be received. Suitable materials for the container 120 may include, but are not limited to, hydrophobic materials such as fluorinated ethylene propylene (Teflon™), other polytetrafluoroethylene (PTFE) substances, or the like.

In one embodiment, the CNT colloidal solution 130 may include CNTs dispersed in a solvent. In some examples, the concentration of the CNTs in the CNT colloidal solution 130 may range from about 0.05 mg/ml to about 0.2 mg/ml, from about 0.1 mg/ml to about 0.2 mg/ml, from about 0.15 mg/ml to about 0.2 mg/ml, from about 0.05 mg/ml to about 0.1 mg/ml, from about 0.05 mg/ml to about 0.15 mg/ml, or from about 0.1 mg/ml to about 0.15 mg/ml. In other examples, the concentration may be about 0.05 mg/ml, about 0.1 mg/ml, about 0.15 mg/ml or about 0.2 mg/ml. The CNT colloidal solution 130 may be prepared by dispersing purified CNTs in a solvent, such as deionized water or an organic solvent, for example, 1,2-dichlorobenzene, dimethyl formamide, benzene, methanol, or the like. Since the CNTs produced by conventional methods may contain impurities, the CNTs may be purified before being dispersed into the solution. The purification may be performed by wet oxidation in an acid solution or dry oxidation, for example. A suitable purification method may include refluxing CNTs in a nitric acid solution (for example, about 2.5 M) and re-suspending the CNTs in water with a surfactant (for example, sodium lauryl sulfate, sodium cholate) at pH 10, and filtering the CNTs using a cross-flow filtration system. The resulting purified CNT suspension may be passed through a filter, such as, for example, a PTFE filter.

The purified CNTs may be in a powder form that may be dispersed into the solvent. In certain embodiments, an ultrasonic wave or microwave treatment may be carried out to facilitate the dispersion of the purified CNTs throughout the solvent. In some examples, the dispersing may be carried out in the presence of a surfactant. Various types of surfactants including, but not limited to, sodium dodecyl sulfate, sodium dodecylbenzenesulfonate, sodium dodecylsulfonate, sodium n-lauroylsarcosinate, sodium alkyl allyl sulfosuccinate, polystyrene sulfonate, dodecyltrimethylammonium bromide, cetyltrimethylammonium bromide, Brij, Tween, Triton X, and poly(vinylpyrrolidone), may be used.

In some embodiments, polymers, such as epoxy, polyvinylalcohol, polyimide, polystyrene, and polyacrylate, may be added to the CNT colloidal solution. Fabricating a CNT paper using a solution containing polymers and CNTs may be advantageous as the polymers present between the CNTs may have a positive influence on the mechanical properties of the resulting CNT paper, such as, for example, an increase in interfacial shear strength.

Figure 4:
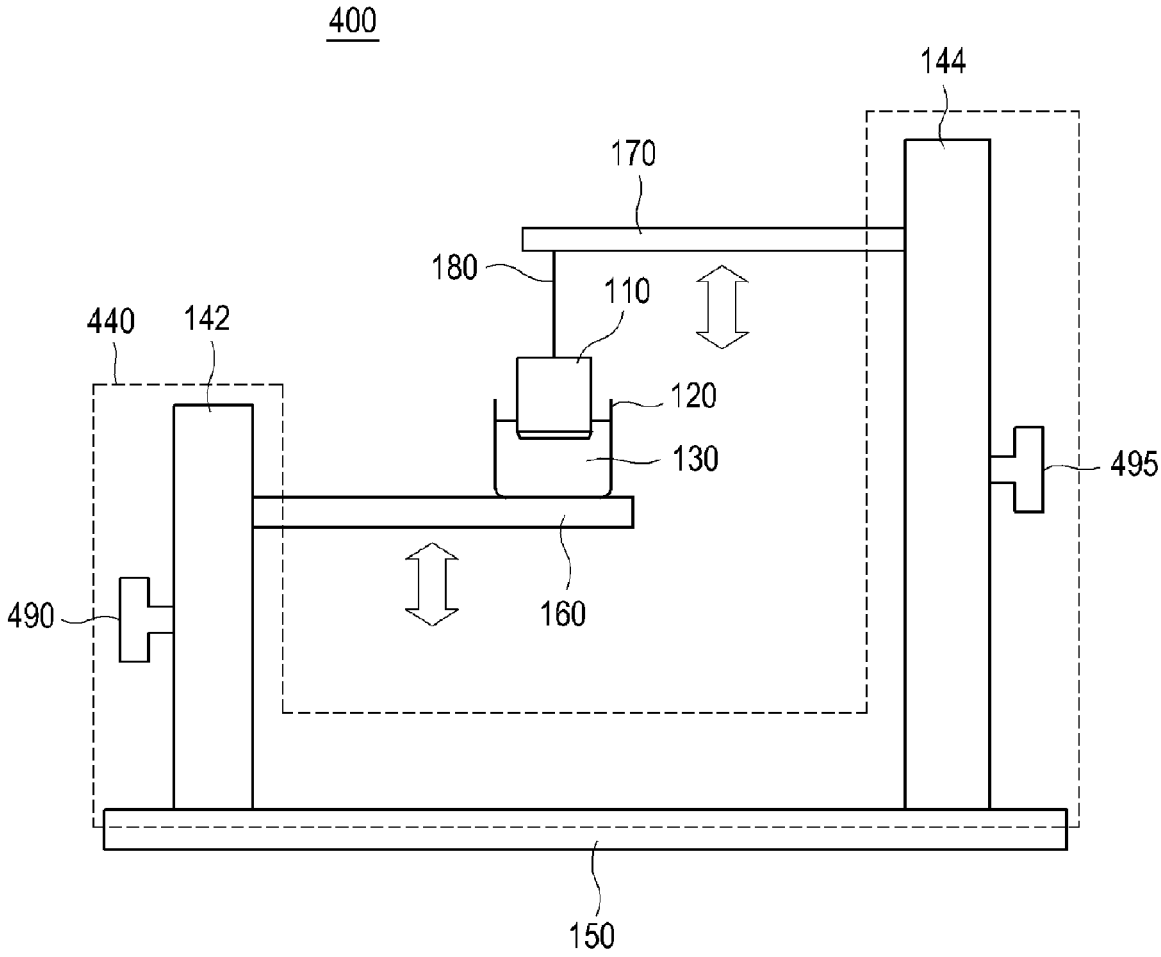
FIG. 4 is a schematic diagram of an illustrative embodiment of an apparatus for making CNT paper.

FIG. 4 shows a schematic diagram of an illustrative embodiment of an apparatus 400 for making a CNT paper. As depicted, the apparatus 400 may include a manipulator 440 that may be configured to dip the structure 110 in and out of the CNT colloidal solution 130. The manipulator 440 may include a left handle 490 and a right handle 495 associated with the left guider 142 and the right guider 144, respectively. The left handle 490 and the right handle 495 may enable an operator to manually manipulate the supporting member 160 (associated with the left guider 142) and the hanger 170 (associated with the right guider 144), respectively. In one embodiment by way of non-limiting example, the left and right handles 490, 495 may be knobs that may be physically connected to the left and right guiders 142, 144, respectively, where a rotation or similar manipulation of the handles 490, 495 may cause the left and right guiders 142, 144 to move the structure 110 in a substantially downward direction toward the container 120 for immersion of the structure 110 into the CNT colloidal solution 130 or in a substantially upward direction away from the container 120 for withdrawal of the structure 110 from the CNT colloidal solution 130. By manually manipulating the supporting member 160 and the hanger 170, the operator may be able to control the velocity at which the structure 110 is withdrawn from the CNT colloidal solution 130 and/or make fine adjustments to the initial and/or final positioning of the structure 110 relative to the container 120. In some embodiments, the apparatus 400 may include, in addition to the handles 490, 495, a motor unit similar to the one depicted in FIG. 1.

Figure 5:
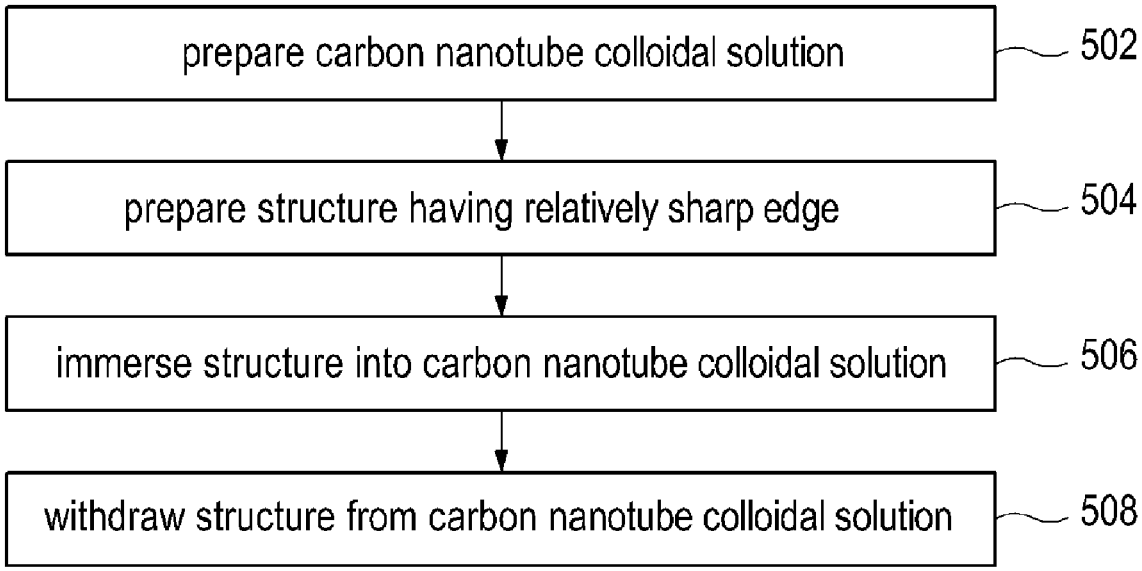
FIG. 5 is a flowchart of an illustrative embodiment of a method for making a CNT paper.

FIG. 5 is a flowchart of an illustrative embodiment of a method for making CNT paper. In FIG. 5, which includes an illustrative embodiment of operational flow, discussion and explanation may be provided with respect to the apparatus and method described herein, and/or with respect to other examples and contexts.

At block 502, the CNT colloidal solution 130 may be prepared by any of the methods described above. At block 504, the structure 110 having the edge portion 214 including the relatively sharp edge 215 may be prepared as described above.

At block 506, the structure 110 may be disposed into the CNT colloidal solution 130. The operation at block 506 may be carried out by moving the structure 110 toward the container 120, so that the structure 110 may be disposed into the CNT colloidal solution 130. In another embodiment, the container 120 containing the CNT colloidal solution 130 may be moved toward the structure 110, so that the structure 110 may be disposed into the CNT colloidal solution 130. In yet another embodiment, both the structure 110 and the container 120 may be simultaneously moved toward each other to dispose the structure 110 into the CNT colloidal solution 130. The structure 110 may be disposed into the CNT colloidal solution 130, such that at least the relatively sharp edge 215 of the edge portion 214 of the structure 110 may be fully immersed in the CNT colloidal solution 130.

At block 508, the structure 110 may be withdrawn from the CNT colloidal solution 130, and CNTs in the CNT colloidal solution 130 may adhere to the relatively sharp edge 215 of the edge portion 214 and form a CNT paper.

Figure 6:
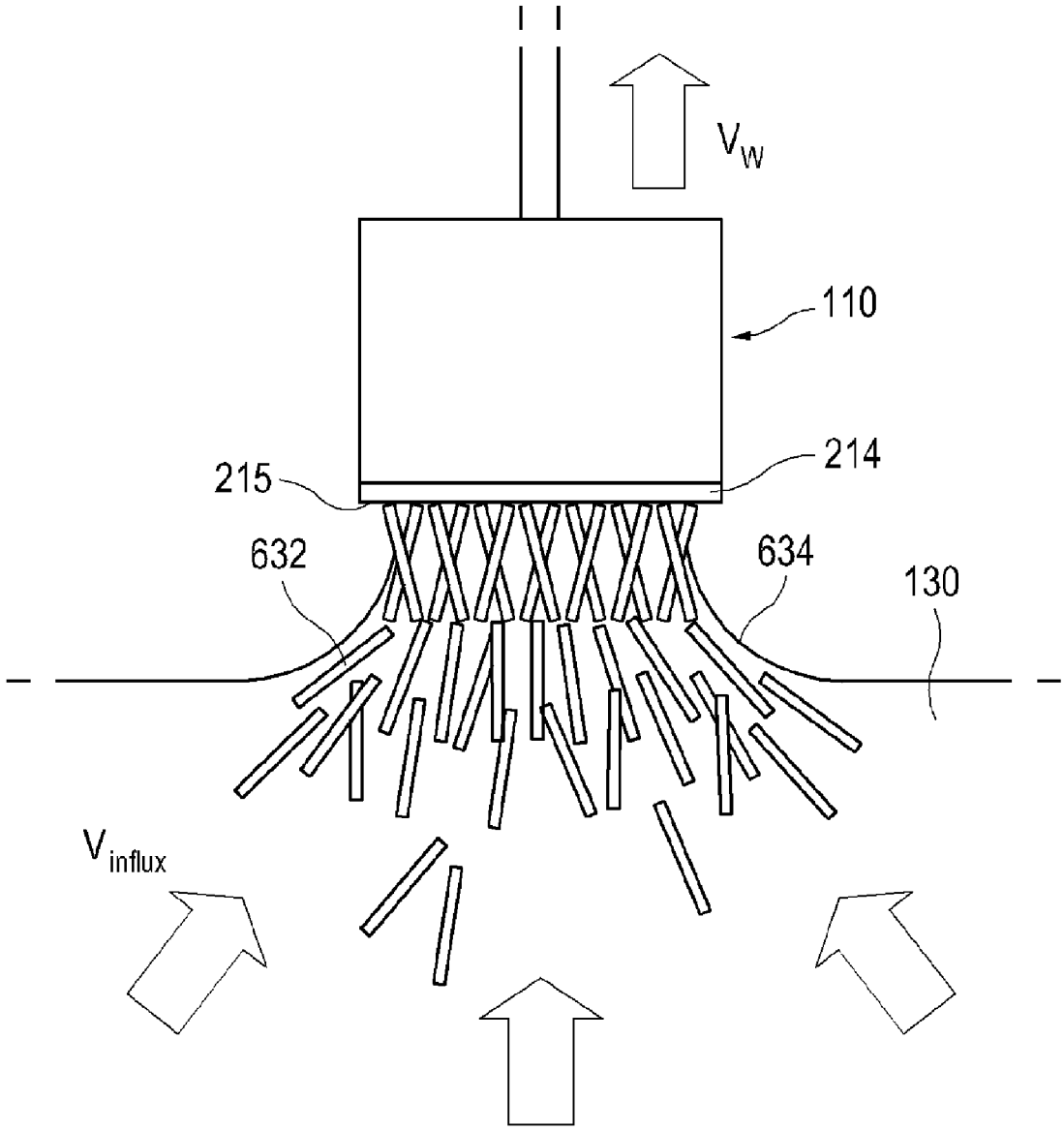
FIG. 6 shows an illustrative embodiment of an interface between a structure having an edge portion including a relatively sharp edge and a CNT colloidal solution when the structure is being withdrawn from the CNT colloidal solution.

FIG. 6 shows an illustrative embodiment of an interface between the structure 110 having the edge portion 214 including the relatively sharp edge 215 and the CNT colloidal solution 130 when the structure 110 is being withdrawn from the CNT colloidal solution 130. As depicted, a CNT paper may be formed at the interface between the relatively sharp edge 215 of the edge portion 214 of the structure 110 and the CNT colloidal solution 130, as the structure 110 may be withdrawn from the CNT colloidal solution 130. Although the embodiments are not limited by a particular mechanism, in the illustrative embodiment, an influx flow ($V_{influx}$) of CNTs 632 may occur toward the structure 110 due to a meniscus 634 whose shape may be determined at least in part by the surface tension force of the CNT colloidal solution 130. The CNTs 632 may adhere to the structure 110 and to one another at least partly due to van der Waals forces. In some embodiments, the influx flow of the CNTs 632 may be in the range of about 1 cm/hour to about 9 cm/hour, from about 3 cm/hour to about 9 cm/hour, from about 5 cm/hour to about 9 cm/hour, from about 7 cm/hour to about 9 cm/hour, from about 1 cm/hour to about 3 cm/hour, from about 1 cm/hour to about 5 cm/hour, from about 1 cm/hour to about 7 cm/hour, from about 3 cm/hour to about 5 cm/hour, from about 3 cm/hour to about 7 cm/hour, or from about 5 cm/hour to about 7 cm/hour. In some other embodiments, the influx flow may be about 1 cm/hour, about 3 cm/hour, about 5 cm/hour, about 7 cm/hour, or about 9 cm/hour. Thus, as the structure 110 may be withdrawn from the CNT colloidal solution 130, a CNT paper that may be a meso- or macro-scale CNT structure including a large number of the CNTs 632, may be extended from the relatively sharp edge 215 of the edge portion 214 of the structure 110.

Referring again to FIG. 5, the operation at block 508 may be carried out, similar to the operation at block 506, by moving the structure 110 and/or the container 120 to withdraw the structure 110 from the CNT colloidal solution 130. The structure 110 may be withdrawn from the CNT colloidal solution 130 at a velocity ranging from about 0.3 mm/min to about 3 mm/min. In some embodiments, the velocity may range from about 1 mm/min to about 3 mm/min, from about 2 mm/min to about 3 mm/min, from about 0.3 mm/min to about 1 mm/min, from about 0.3 mm/min to about 2 mm/min, or from about 1 mm/min to about 2 mm/min. In some other embodiments, the velocity may be about 0.3 mm/min, about 1 mm/min, about 2 mm/min, or about 3 mm/min. In some embodiments, a sensor (not shown) may be used to determine the specific velocity by which the structure 110 may be withdrawn from the CNT colloidal solution 130, and a user may control the withdrawal velocity. The withdrawal velocity ($V_W$) may be determined at least in part by the viscosity of the CNT colloidal solution 130. For example, for a higher viscosity of the CNT colloidal solution 130 or a smaller target thickness of the CNT paper, a withdrawal velocity of the structure 110 may be higher. The withdrawal velocity of the structure 110 may vary or otherwise remain constant. The presence of the extensions 330, 330' in the structure 110, as illustrated in FIG. 3, may affect the direction of the surface tension force between the structure 110 and the CNT colloidal solution 130 when withdrawing the structure 110 from the CNT colloidal solution 130, and may prevent the formed CNT paper from slipping from the edge portion 214 of the structure 110.

In some embodiments, the structure 110 may be withdrawn from the CNT colloidal solution 130 at a certain direction relative to the surface of the CNT colloidal solution 130. In one embodiment, the structure 110 may be withdrawn along a direction substantially perpendicular to the surface of the CNT colloidal solution 130. In other embodiments, the structure 110 may be withdrawn following a line that is not perpendicular to the surface of the CNT colloidal solution 130.

The above operations at block 506 and block 508 may be carried out under ambient conditions. For example, the disposing and withdrawing of the structure 110 into and from the CNT colloidal solution 130 may be carried out at room temperature (for example, about 25° C.), at a relative humidity of about 30%, and at atmospheric pressure (approximately 1 atm). It should be appreciated that the ambient conditions may be varied depending on a variety of factors, such as the type of the structure 110 and concentration of the CNT colloidal solution 130, the target thickness of the CNT paper, etc.

The operations in block 506 and block 508 may be carried out by executing a processor-readable or computer-readable program to control the disposing and the withdrawal of the structure 110.

The CNT papers produced by the illustrative embodiments described above may have lengths ranging from about 0.5 cm to about 20 cm and thicknesses ranging from about 0.5 nm to about 100 μm. In some embodiments, the length may range from about 1 cm to about 20 cm, from about 5 cm to about 20 cm, from about 10 cm to about 20 cm, from about 0.5 cm to about 1 cm, from about 0.5 cm to about 5 cm, from about 0.5 cm to about 10 cm, from about 1 cm to about 5 cm, from about 1 cm to about 10 cm, or from about 5 cm to about 10 cm. In some other embodiments, the length may be about 0.5 cm, about 1 cm, about 5 cm, about 10 cm, or about 20 cm. In some embodiments, the thickness may range from about 1 nm to about 100 μm, from about 10 nm to about 100 μm, from about 100 nm to about 100 μm, from about 1 μm to about 100 μm, from about 10 μm to about 100 μm, from about 0.5 nm to about 1 nm, from about 0.5 nm to about 10 nm, from about 0.5 nm to about 100 nm, from about 0.5 nm to about 1 μm, from about 0.5 nm to about 10 μm, from about 1 nm to about 10 nm, from about 10 nm to about 100 nm, from about 100 nm to about 1 μm, or from about 1 μm to about 10 μm. In some other embodiments, the thicknesses may be about 0.5 nm, about 1 nm, about 10 nm, about 100 nm, about 1 μm, about 10 μm, or about 100 μm. In certain embodiments, a CNT paper may be further extended by disposing one end of the CNT paper into a CNT colloidal solution and then withdrawing it from the CNT colloidal solution at a certain withdrawing speed. For example, such a process may be repeated more than once to make a CNT paper having a length of about 100 cm or longer.

The illustrative embodiments described above for making a CNT paper may also be performed with more than one structure 110 in order to mass-produce CNT papers in a simple and efficient manner with high yields.

The produced CNT paper may also be subjected to various post-treatments including, but without limitation, polymer coating, UV-irradiation, thermal annealing, and electroplating.

The illustrative embodiments described herein may enable the manufacturing of a freestanding CNT paper having a substantially pure, isotropic CNT network without necessarily having other supporting structures. The CNT papers formed in accordance with any of the above described embodiments may have high porosity, and improved mechanical, electrical and chemical properties.

In light of the present disclosure, those skilled in the art will appreciate that the apparatus and methods described herein may be implemented in hardware, software, firmware, middleware, or combinations thereof and utilized in systems, subsystems, components, or sub-components thereof. For example, a method implemented in software may include computer code to perform the operations of the method. This computer code may be stored in a machine-readable medium, such as a processor-readable medium or a computer program product, or transmitted as a computer data signal embodied in a carrier wave, or a signal modulated by a carrier, over a transmission medium or communication link. The machine-readable medium or processor-readable medium may include any medium capable of storing or transferring information in a form readable and executable by a machine (e.g., by a processor, a computer, etc.).

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A method for making a carbon nanotube (CNT) paper comprising:

disposing a blade having a sharp edge portion into a CNT colloidal solution such that CNTs in the CNT colloidal solution adhere to the sharp edge portion; and withdrawing the blade from the CNT colloidal solution to form the CNT paper at the interface between the sharp edge portion and the CNT colloidal solution, wherein an influx of carbon nanotubes from the CNT colloidal solution towards the blade occurs due to a meniscus and the influx is in the range of about 1 cm/hour to about 9 cm/hour.

2. The method of claim 1, further comprising:

preparing the blade having the sharp edge portion.

3. The method of claim 1, further comprising:

preparing the CNT colloidal solution.

4. The method of claim 3, wherein the preparing the CNT colloid solution comprises dispersing purified CNTs in a solvent.

5. The method of claim 1, wherein the sharp edge portion of the blade has a thickness of about 0.5 nm to about 300 μm.

6. The method of claim 1, wherein the sharp edge portion of the blade comprises a hydrophilic surface property.

7. The method of claim 1, wherein the sharp edge portion of the blade comprises a metal.

8. The method of claim 7, wherein the metal comprises tungsten.

9. The method of claim 1, wherein the sharp edge portion of the blade comprises a self-assembled monolayer coating.

10. The method of claim 1, wherein the structure comprises extensions attached to two opposing side edges of the structure.

11. The method of claim 1, wherein the withdrawing the structure comprises withdrawing the structure from the CNT colloidal solution at a predetermined withdrawal velocity.

12. The method of claim 11, wherein the predetermined withdrawal velocity is about 0.3 mm/min to about 3 mm/min.

13. A method for making a carbon nanotube (CNT) paper comprising:

disposing a structure having an edge portion into a CNT colloidal solution such that CNTs in the CNT colloidal solution adhere to the edge portion, wherein the edge portion has a thickness of about 0.5 nm to about 300 μm; and withdrawing the structure from the CNT colloidal solution to form the CNT paper extending from the edge portion to the CNT colloidal solution, wherein an influx of carbon nanotubes from the CNT colloidal solution towards the blade occurs due to a meniscus and the influx is in the range of about 1 cm/hour to about 9 cm/hour, wherein the CNT paper has a final length in the range of about 0.5 cm to about 20 cm.

14. A method for making a carbon nanotube sheet comprising:

disposing a blade having a sharp edge portion into a carbon nanotube colloidal solution such that carbon nanotubes in the colloidal solution adhere to the sharp edge portion, wherein the sharp edge portion has a thickness of about 0.5 nm to about 300 μm, and the colloidal solution comprises about 0.05 mg/mL to about 0.2 mg/mL of carbon nanotubes dispersed in a solvent; and withdrawing the blade from the colloidal solution to form the carbon nanotube sheet extending from the sharp edge portion to the CNT colloidal solution, wherein the blade is withdrawn at a rate of about 0.3 mm/min, to about 3.0 mm/min, and wherein an influx of carbon nanotubes from the colloidal solution towards the blade occurs due to a meniscus and the influx is in the range of about 1 cm/hour to about 9 cm/hour, wherein the carbon nanotube sheet has a final length in the range of about 0.5 cm to about 20 cm and a thickness in the range of about 0.5 nm to about 100 μm.

15. The method of claim 1, wherein the influx flow is in the range of about 3 cm/hour to about 7 cm/hour.

16. The method of claim 1, wherein the CNT colloidal solution further comprises a polymer.

17. The method of claim 16, wherein the polymer is selected from the group consisting of an epoxy, a polyvinyl alcohol, a polyimide, a polystyrene, and a polyacrylate.

* * * * *

UNITED STATES PATENT AND TRADEMARK OFFICE

CERTIFICATE OF CORRECTION

PATENT NO. : 8,021,640 B2
APPLICATION NO. : 12/198815
DATED : September 20, 2011
INVENTOR(S) : Kim et al.

It is certified that error appears in the above-identified patent and that said Letters Patent is hereby corrected as shown below:

On the title page, item (56), under "OTHER PUBLICATIONS", in Column 2, Line 1, delete "attachent" and insert -- attachment --, therefor.

On the title page, item (56), under "OTHER PUBLICATIONS", in Column 2, Line 7, delete "functonalize templates, Chemical Physicas" and insert -- functionalize templates, Chemical Physics --, therefor.

In Column 6, Line 10, delete "min" and insert -- min. --, therefor at each occurrence throughout the patent.

In Column 8, Line 4, in Claim 4, delete "colloid" and insert -- colloidal --, therefor.

In Column 8, Line 48, in Claim 14, delete "min," and insert -- min. --, therefor.

Signed and Sealed this
Nineteenth Day of June, 2012

David J. Kappos

David J. Kappos
*Director of the United States Patent and Trademark Office*